US005564697A

United States Patent [19]

Catrinar

[11] Patent Number: 5,564,697

[45] Date of Patent: Oct. 15, 1996

[54] TABLE TOP GAME APPARATUS

[76] Inventor: Thomas J. Catrinar, 7000 Ten Mile Rd., Apt. 610, Center Line, Mich. 48015

[21] Appl. No.: 589,493

[22] Filed: Jan. 22, 1996

[51] Int. Cl.[6] ..... A63F 7/00

[52] U.S. Cl. ..... 273/126 R; 273/119 R; 273/129 S

[58] Field of Search ..... 283/126 R, 108, 283/113, 118 R, 119 R, 123 R, 129 R, 129 V, 129 W

[56] References Cited

U.S. PATENT DOCUMENTS

| | | | |
|---|---|---|---|
| 738,023 | 9/1903 | Fulton et al. | 273/113 |
| 2,506,867 | 5/1950 | Gilliam, Jr. et al. . | |
| 2,636,740 | 4/1953 | McNeal | 273/118 R |
| 3,033,569 | 5/1962 | Hunt . | |
| 3,082,003 | 3/1963 | McConathy . | |
| 3,203,699 | 8/1965 | Pearson, Jr. | 273/123 R |
| 3,656,753 | 4/1972 | Juneau . | |
| 3,927,884 | 12/1975 | Glass et al. | 273/119 R |
| 4,132,411 | 1/1979 | Brescow et al. . | |

*Primary Examiner*—Raleigh W. Chiu
*Attorney, Agent, or Firm*—Peter D. Keefe

[57] ABSTRACT

A table top game apparatus includes a circular play area peripherally demarcated by an annular trough, a plurality of disk shaped game-pieces, a game-piece propelling mechanism which is located at, and movable along, the trough, and an annular confinement wall adjacent the trough opposite the play area. The game-piece propelling mechanism is pivotally mounted upon a base which is, in turn, slidably or rollably seated in the trough. The trough includes provision for selectively partitioning it to receive in selected partitions game-pieces which will land there during the course of play of a particular game. The annular confinement wall is preferably provided with selectively movable markers for providing location and play information juxtaposed a particular portion of the trough, such as at particular partitions. Various configurations of the table top game apparatus accommodate a range of percussion games involving sliding game-pieces and rolling game-pieces.

20 Claims, 4 Drawing Sheets

TABLE TOP GAME APPARATUS

BACKGROUND OF THE INVENTION

1. Field of the Invention

The present invention relates to table top game apparatus, and more particularly to an apparatus of the aforesaid type having a play area upon which game-pieces are moved according to the rules of a selected game. Still more particularly, the present invention relates to a table top game apparatus which is adaptable to the play a plurality of games, including for example marble games and game-piece percussion games.

2. Description of the Prior Art

Table top game apparatus known in the art, such as for example billiards and those table top game apparatus described by U.S. Pat. Nos. 2,506,867, 3,033,569, 3,082,003, 3,656,753 and 4,132,411, are generally configured to provide a gaming area for a selected game or for a closely related class of games.

However, apparatus which provide only for a single class of table top games can become boring after an extended period of use by the players. What is needed in the art is a table top game apparatus which is adapted to readily accommodate the play of many different games, not necessarily closely related games, so that always the apparatus provides refreshingly new games to challenge even long term players.

SUMMARY OF THE INVENTION

The present invention is a table top game apparatus which accommodates the play of many different games with only a minimal amount of reconfiguration to play games which are very different.

The table top game apparatus according to the present invention includes according to a preferred form of game play, a circular play area peripherally demarcated by an annular trough, a plurality of disk shaped game-pieces, a game-piece propelling mechanism which is located at, and movable along, the trough, and an annular confinement wall adjacent the trough opposite the play area. The game-piece propelling mechanism is pivotally mounted upon a base which is, in turn, slidably or rollably seated in the trough. The trough includes provision for selectively partitioning it to receive in selected partitions game-pieces which will land there during the course of play of a particular game. The annular confinement wall is preferably provided with selectively movable markers for providing location and play information juxtaposed a particular portion of the trough, such as at particular partitions.

In this configuration, the table top game apparatus accommodates a range of percussion games wherein game-pieces are propelled by the game-piece propelling mechanism to thereby achieve a game scoring result, such as for example collision on the play area with an opponent's game-piece which is thereupon caused to be knocked into a selected partition of the trough.

The table top game apparatus according to the present invention further preferably includes removable play surface members, such as for example a padded play surface member for the playing of marbles games or a hard and smooth play surface member for the play of disk sliding percussion games. Further, it is preferred for the game-piece propelling mechanism to be selectively removable from the base, wherein removal thereof permits a selected basal surface member to be placed upon the base which then conjoins the play surface member of the play area parallel with the plane of play thereof. Still further, it is preferred for the legs which support the table to be individually adjustable so that the height and the attitude of the play area may be adjusted to suit installation and play situations.

Accordingly, it is an object of the present invention to provide a table top game apparatus which accommodates the play of a plurality of distinctly different games.

It is a further object of the present invention to provide a table top game apparatus which includes a play area concentrically surrounded by an annular trough and a confinement wall.

It is another object of the present invention to provide a table top game apparatus which includes a play area concentrically surrounded by an annular trough and a confinement wall, wherein a game-piece propelling mechanism is interfaced with the trough to be movable therealong.

It is an additional object of the present invention to provide a table top game apparatus which includes a play area concentrically surrounded by an annular trough and a confinement wall, wherein play surface members are selectively replaceable to thereby accommodate games involving differing types of game-pieces, such as for example rolling game-pieces and sliding game-pieces.

These, and additional objects, advantages, features and benefits of the present invention will become apparent from the following specification.

DETAILED DESCRIPTION OF THE PREFERRED EMBODIMENT

Figure 1:
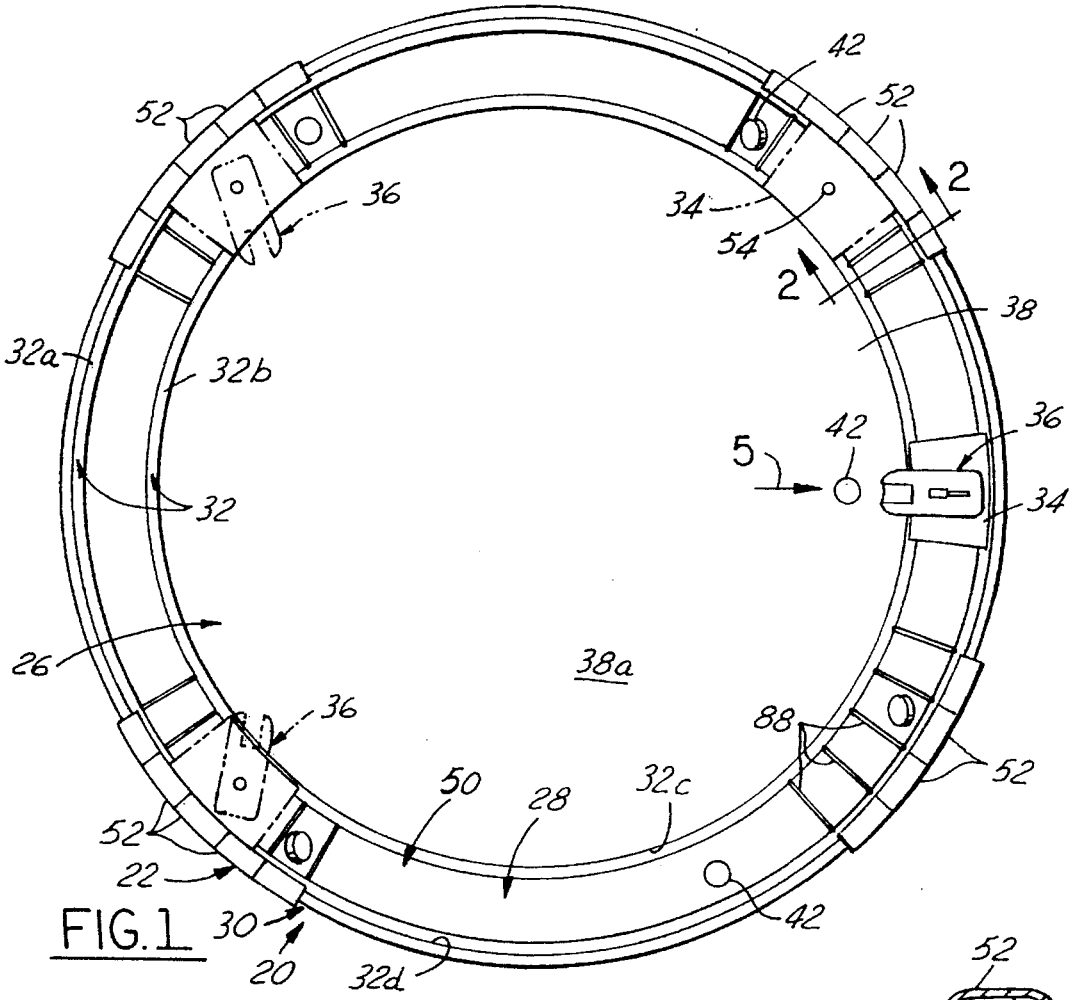
FIG. 1 is a top plan view of the table top game apparatus according to the present invention.
Figure 9:
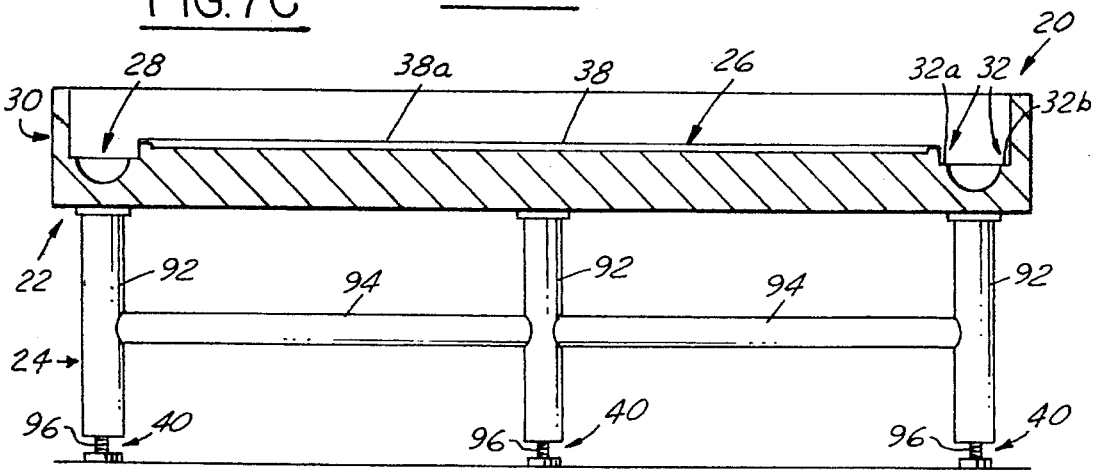
FIG. 9 is a partly sectional side view of the table top game apparatus.

An overview of the table top game apparatus 20 can be discerned by collective reference to FIGS. 1 and 9. The table top game apparatus 20 includes a table top 22 and a support member 24 therefor. The table top 22 has a generally circular cross-section. A centrally disposed play area 26 is demarcated by an annular trough 28, wherein the trough abuts the play area. The opposite side of the trough 28 (opposite the play area 26) abuts an annular confinement wail 30. The trough 28 includes an annular conveyance seat 32 characterized by inner and outer ledge portions 32*a* , 32*b* and inner and outer walls 32*c*, 32*d*. A base 34 is seatably fitted to the annular conveyance seat 32 so as to be movable (slidably or rollably) therealong. A game-piece propelling mechanism 36 is rotatably mounted to the base 34. The table top 22 preferably includes selectively removable play surface members 38 which provide flat play surfaces which may be for example padded or hard and smooth. The support member 24 raises the play area 26 to preferably more-or-less a little below waist height (about three feet), and includes height adjusters 40 for leveling the table top 22. Typically, the table top game apparatus 20 is used in conjunction with game-pieces 42, for example disks, in the course of play of a selected game (see examples thereof hereinbelow), wherein the disks are propelled (or "shot") by the game-piece propelling mechanism 36 in a selected direction to interact in a percussional manner with one or more disks on the play area 26.

The structure and function of the table top game apparatus 20 will now be detailed with greater particularity with additional reference to the remaining figures.

The table top 22 is constructed of a suitable rigid construction material, such as for example wood, plastic, fiber glass, aluminum or a composite. The dimension of the cross-section of the table top 22 is selected as is appropriate for the types of games to be played and the size and lay-out of the room at which the table top game apparatus 20 is to be installed. For example, the table top 22 may have a cross-section of about six feet eight inches and a corresponding cross-section of the play area 26 of about five feet six inches. Preferably, the table top 22 (inclusive of the confinement wall 30) is formed of an integral single piece in order to provide rigidity to the play area 26 and the trough 28, however, it is of course possible to construct the table top otherwise (such as in modular form) and yet provide the required rigidity using suitable fasteners and/or adhesives.

Figure 2:
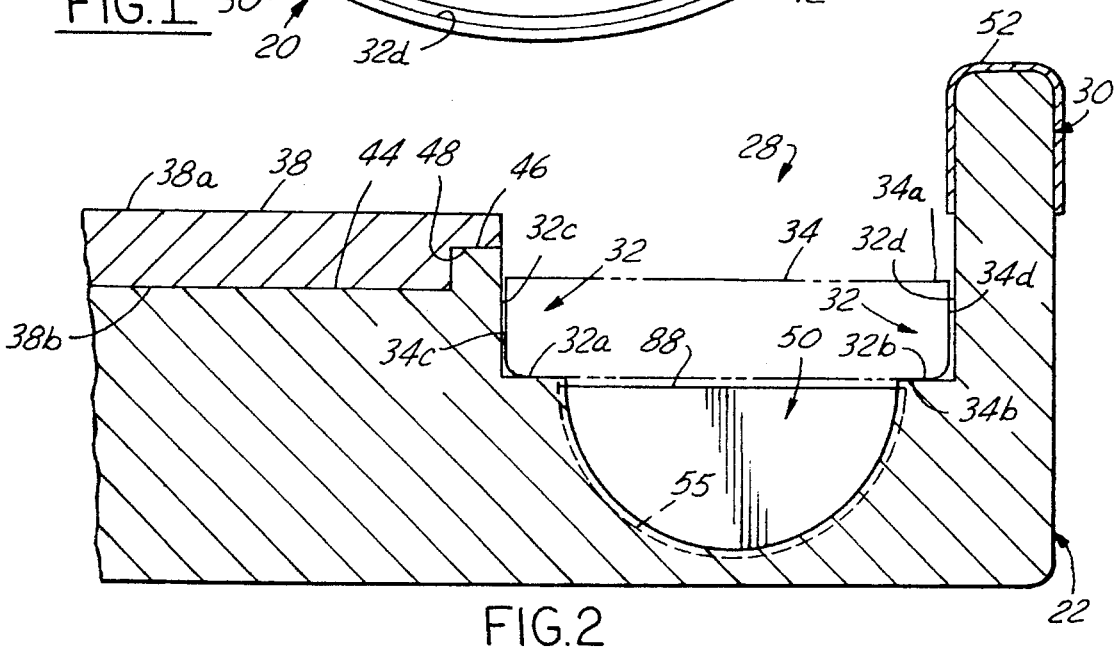
FIG. 2 is a partly sectional side view of the table of the table top game apparatus, seen along line 2—2 in FIG. 1.

As shown by FIG. 2, the table top 22 is provided with a play area recess 44 an annular lip 46 located adjacent the inner wall 32*c* of the conveyance seat 32. The play surface member 38 seats into the play area recess 44 and the lip 46 serves to align the removable play surface member with respect to the trough 28. In this regard, the underside 38*b* of the play surface member 38 is provided with an annular notch 48 which abuttingly interfaces with the lip 46.

As further shown by FIG. 2, the trough 28 includes a preferably concave shaped bottom portion 50 located between the inner and outer ledge portions 32*a*, 32*b*, wherein the aforementioned conveyance seat 32 is located thereabove. Each of the inner and outer ledge portions 32*a*, 32*b* is oriented parallel with the play area recess 44. An example of the width of each of the inner and outer ledge portions 32*a*, 32*b* is about one and one-half inch, whereupon an example of the width of the trough at the conveyance seat 32 as measured between the inner wall 32*c* and outer wall 32*d* thereof is about eight and one-half inches.

FIG. 2 also depicts that the confinement wall 30 extends upwardly from the trough 28 to a suitable height above the play surface 38*a* of the play surface member 38 in order to retain game-pieces confined to the table top 22 when hit percussionally. An example of a suitable height of the confinement wall 30 above the height of the play surface 38*a* is about three and one-half inches. It will be further noted (see additionally FIGS. 1, 2 and 5) that markers 52, such as for example in the form of resilient U-shaped clips, are selectively locatable upon the confinement wall 30. The markers 52 are provided with indicia, such as for example numeric, alpha, alpha-numeric, colors, or designs, for assisting with respect to play of a game (as discussed hereinbelow).

The base 34 seats in the conveyance seat 32 whereby the underside 34*b* thereof rests upon the inner and outer ledge portions 32*a*, 32*b* of the conveyance seat and the curvilinear inner and outer edges 34*c*, 34*d* thereof guidably abut the inner and outer walls 32*c*, 32*d* so that the base is easily movable guidably along the trough 28. In operation of the base 34 with respect to the trough 28, the players move the base from one location of the trough to another by applying gentle hand pressure to the base.

The concave portion 50 of the trough 28 is intended to serve as a repository of game-pieces 42 which have left the play area 26 such that the game-pieces are located below the underside 34*b* of the base 34, whereby the base is able to move along the trough without interference from any game-pieces resting therein. As shown in FIG. 2, the concave portion 50 of the trough 28 is optionally provided with regularly spaced apart partition wall grooves 55. The placement of the partition wall grooves 55 may be all around the trough, or only selectively around the trough, such as a plurality thereof at ninety degree locations, as shown by FIG. 1.

Figure 4:
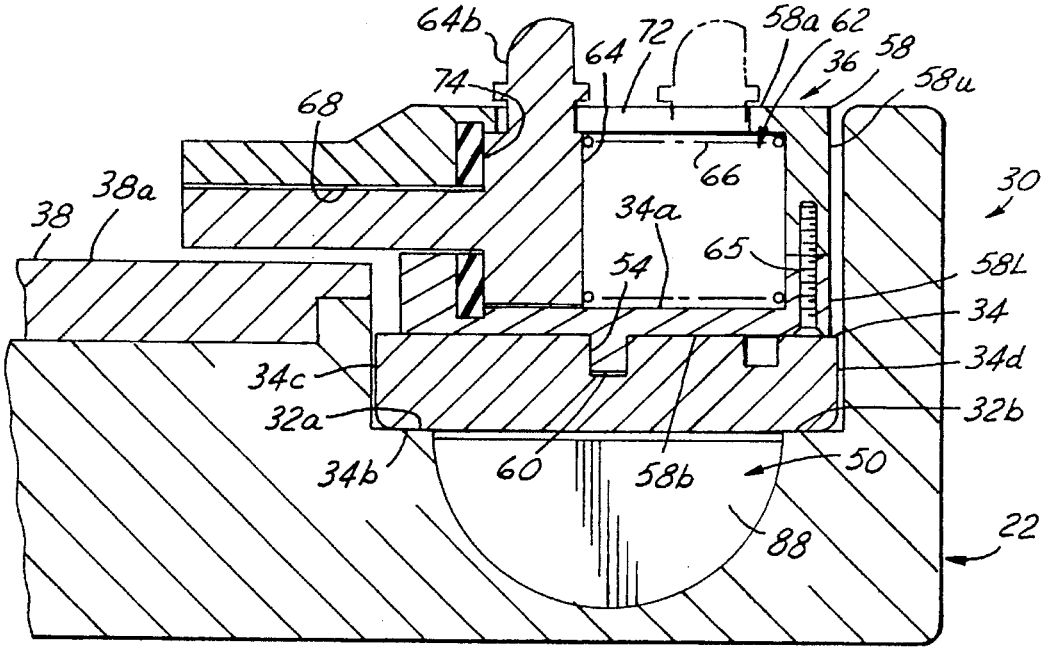
FIG. 4 is a partly sectional side view of the table top game apparatus, seen along line 4—4 in FIG. 3 wherein the percussion actuator is now shown in a position after having propelled the game-piece.
Figure 3:
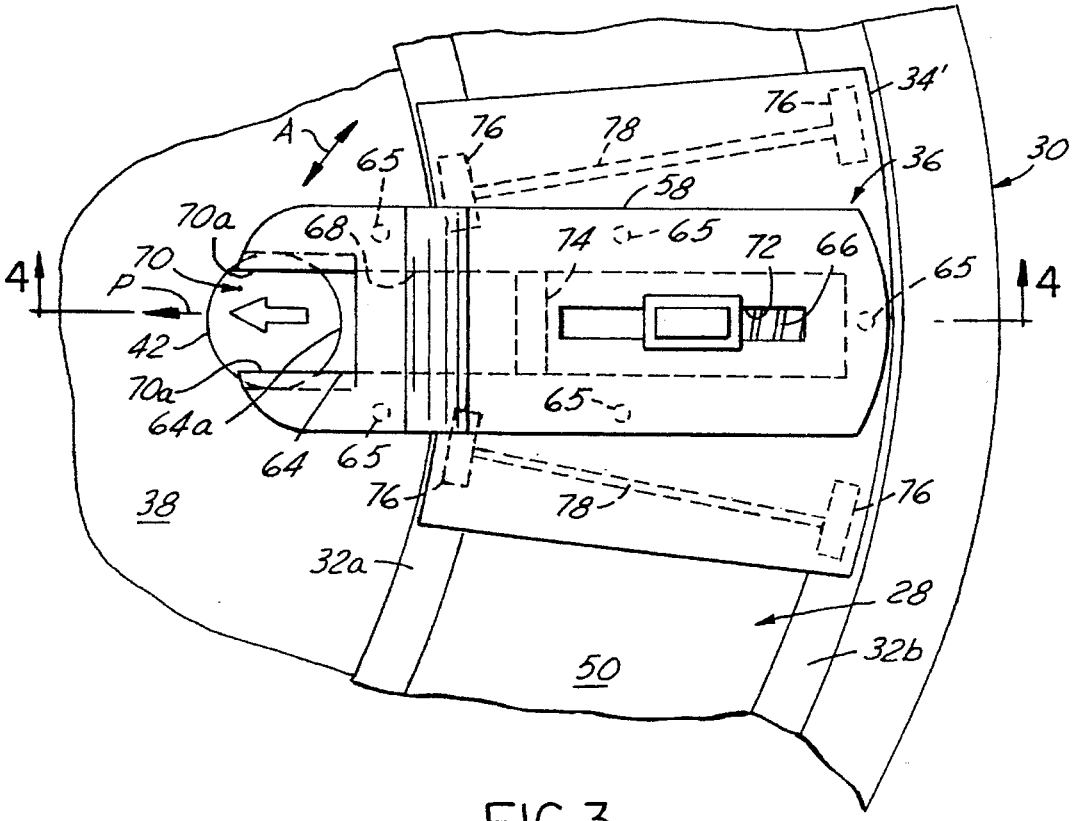
FIG. 3 is a detail top plan view of the table top game apparatus, showing the game-piece propelling mechanism thereof wherein the percussion actuator is propelling a game-piece.
Figure 5:
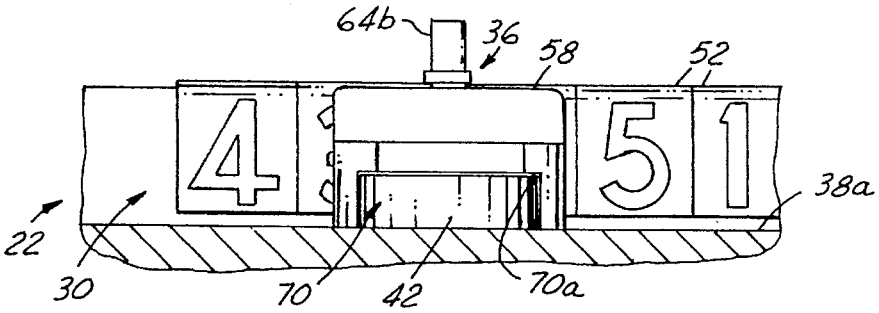
FIG. 5 is a detail view of the table top game apparatus, seen along arrow 5 in FIG. 1.

Referring now to FIGS. 3, 4 and 5, the game-piece propelling mechanism 36 will be described.

The base 34 has an upper side 34*a* into which is formed a centrally disposed blind bore 54. The game-piece propelling mechanism 36 includes a housing 58 having an under side 58*b* which rests upon the upper side 34*a* of the base 34. The under side 58*b* of the housing 58 has a stud 60 which seats into the blind bore 54 to thereby guide rotatable movement of the game-piece propelling mechanism about the blind bore in the plane of the upper side 34*a* of the base 34, as indicated by arrow A.

The housing 58 is formed of upper and lower portions 58U, 58L which are connected together by threaded fasteners 65, and has an internal hollow 62 in which is located a percussion actuator 64 and a percussion spring 66. The forward end of the internal hollow 62 has an opening 68 through which the percussion actuator 64 extends, terminating in a game-piece seat 70 for receiving therein a game-piece in ready for being struck propellingly by a percussion face 64*a* of the percussion actuator. The game-piece seat includes preferably a cut-out area whereby the player can see the game-piece 42 as it is situated in the game-piece seat and further has overhead tongues 70 for preventing the game-piece for inadvertently flying upwardly when struck by the percussion armature 64. The housing 58 has a slot 72 at the upper side 58*a* thereof through which extends an actuator knob 64*b* of the percussion actuator 64.

In operation of the game-piece percussion mechanism 36, the player pulls back on the actuator knob 64*b* to thereby compress the percussion spring 66 and provide for placement in the game-piece seat 70 for a selected game-piece 42. The player then releases the percussion armature, whereupon the percussion face 64*a* will then strike the game-piece and push it propellingly along arrow P out from the game-piece seat. When the percussion armature reaches its limit of movement under urging of the percussion spring, it strikes a resilient impact pad 74, which may be for example composed of a rubber coated plastic or a rigid neoprene material. The propelling direction is determined by the player selecting the orientation of the game-piece propelling mechanism by rotating it along arrow A. Further, the location of the game-piece propelling mechanism is determined by its selected moved-to placement along the trough 28.

Figure 10:
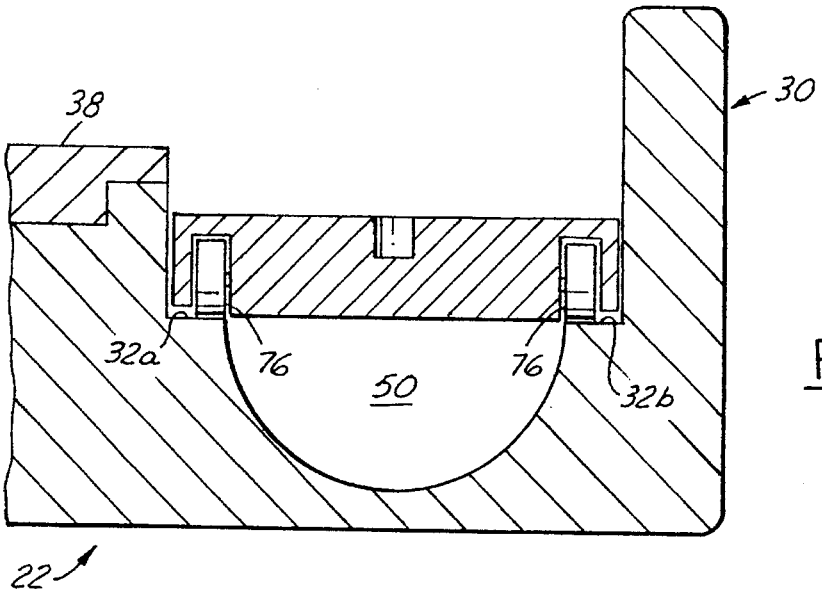
FIG. 10 is a detail partly sectional side view of the table of the table top game apparatus, showing a base for a game-piece propelling mechanism which is rollingly interfaced with the trough.

To minimize the friction between the base 34 and the trough 28, the interface between the base and the trough is preferably provided with low sliding friction materials, such as polytetrafluoroethylene (commonly known as TEFLON, a registered trademark product of E.I. du Pont de Nemours & Co. of Wilmington, Del.). In order to minimize frictional effects even further, wheels 76 may be rotatably connected (releasably or fixedly) with the base 34' to thereby rollably interface with the inner and outer ledge portions 32*a*, 32*b* (see FIGS. 4 and 10). In this regard, the wheels 76 must each rotate independently and each be mounted on a radially oriented axle 78 (see FIG. 4) in order for the rolling action to be tangential and therefore mechanically correct. Preferably, the interface at the inner and outer walls is polytetrafluoroethylene (or otherwise like) provided.

Figure 11:
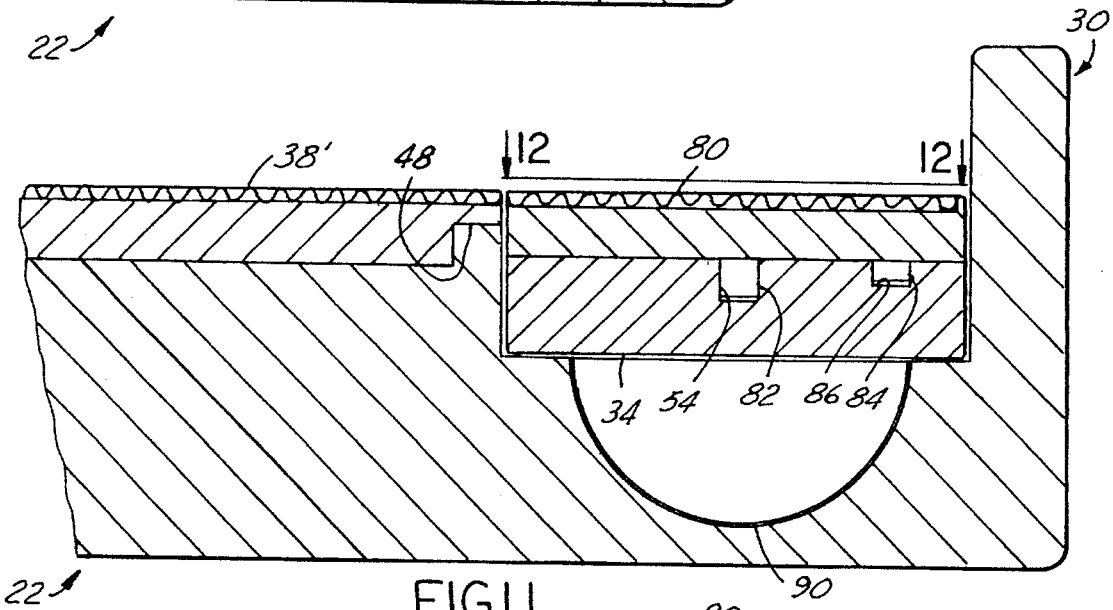
FIG. 11 is a detail partly sectional edge view of the table top game apparatus, showing the base having the game-piece propelling mechanism removed and a basal surface member placed thereupon instead.

For some games, it may be necessary to provide a play surface at the base 34. In this regard, the game-piece propelling mechanism 36 is separated from the base by pulling the stud 60 out of the blind bore 54. Then, as shown in FIG. 11, a basal play surface member 80 is placed over the base 34. In this regard, it is not desirable for the basal surface member 80 to be rotatable with respect to the base 34. Therefore, not only does a primary stud 82 of the basal surface member insert into the blind bore 54, but also a secondary stud 84 inserts into a secondary blind bore 86 of the base at a location spaced from the blind bore 54.

Figure 13:
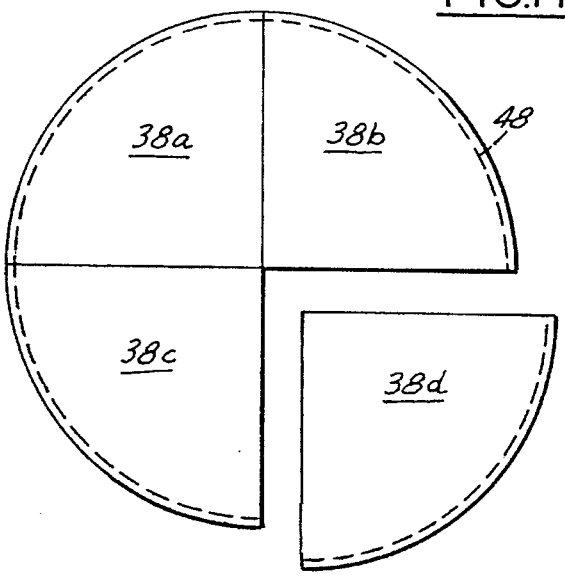
FIG. 13 is a top plan view of the playing area of the table top game apparatus, showing a selected removable play surface member, wherein one section thereof is being removed or installed with respect to the table top.
Figure 12:
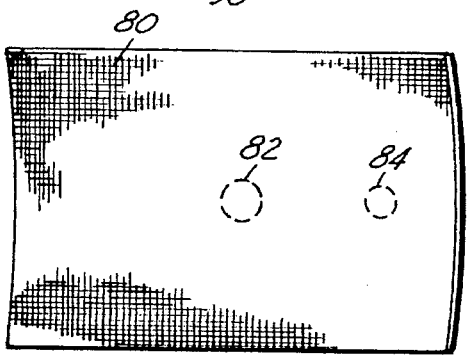
FIG. 12 is a top plan view of the basal surface member, seen along line 12—12 in FIG. 11.

FIGS. 11 and 12 depict a felt covered, padded basal surface member 80, and a matching felt covered, padded play surface member 38'. Clearly, a hard and smooth basal surface member could replace the padded basal surface member 80 to thereby match the hard and smooth play surface member 38 of FIG. 1. FIG. 13 shows a modification of the play surface member 38 which is formed of four quadratic sections, 38*a*, 38*b*, 38*c*, and 38*d* for providing ease of set-up and storage.

Figure 6:
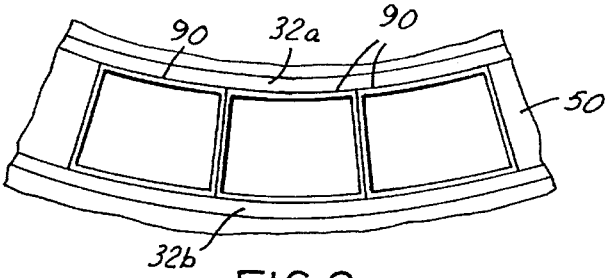
FIG. 6 is a detail plan view of trough located partitions provided by a plurality of selectively removable cups.

One preferred way to provide for partitioning of the trough 28 is via the aforesaid partition wall grooves 55 which selectively receive semi-circular partition walls 88 (see FIGS. 1, 2 and 4). Another preferred way to provide partitioning of the trough is to provide a plurality of cups which are form fitted to be received into the concave portion 50 of the trough 28 (see FIGS. 6 and 11).

Returning for a moment to the support member 24, it is preferred to have four regularly spaced apart legs 92 which are securely connected with the table top 22 and which are mutually rigidified by bracing 94. At the bottom of the legs 92 are the height adjusters 40. As depicted in FIG. 9, a preferred form of the height adjusters 40 is for a foot 96 to threadably engage its respective leg, wherein threading adjusts the location of the sole of the foot with respect to the leg.

Figure 7A:
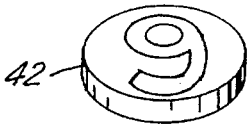
FIGS. 7A through 7D depict various forms of game-pieces for the table top game apparatus.
Figure 7B:
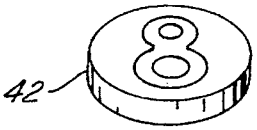
Figure 7C:
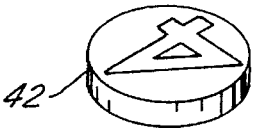
Figure 7D:
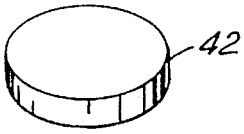

FIGS. 7A through 7D depict various game-pieces 42 in the form of disks, the difference being the indicia thereupon. In this regard, FIG. 4 depicts a "shooter" disk having an arrow indicia, FIG. 7A depicts a white colored numeral indicia disk, FIG. 7*b* depicts a black colored numeral 8 indicia disk, FIG. 7*c* depicts a red colored numeral indicia disk, and FIG. 7*d* depicts plain disk having no indicia.

Figure 8:
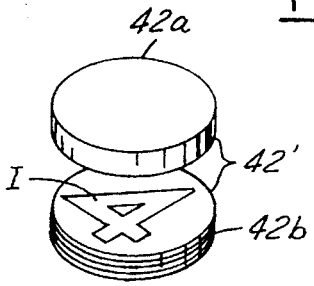
FIG. 8 depicts a game-piece for the table top game apparatus, wherein the value indicia thereof is selectively concealed.

FIG. 8 depicts a undue game-piece 42' wherein the indicia I is hidden inside a cap 42*a*. The cap 42*a* may screw onto or may snap onto the main portion 42*b* of the disk 42'.

In order to understand the operation of the table top game apparatus 20, it is instructive to elaborate play of various possible games playable therewith. It is to be understood that a myriad of games can be played with the table top game apparatus 20, and the hereinbelow examples are given only by way of instructive example, and not limitation.

GAME EXAMPLE 1

Game-pieces: 16 target disks composed of 8 red target disks numbered 1 through 8 and 8 white target disks numbered 9 through 16; and 1 green shooter disk having a yellow arrow indicia. Other accessories: smooth, low friction play surface member; one location marker per player; and the game-piece propelling mechanism is mounted to the base. Object: to present each opposing player the most difficult preliminary shots as the game progresses.

The game begins with each player picking a color and the toss of a coin (or otherwise) to see who plays first. The target disks are placed in a tight arrangement on the play area, and the first player propels the shooter disk thereinto to disperse the target disks; any target disks which fall into the trough are returned to the center of the play area.

The first shot for each play must start from the same location on the table. Before the first shot, after the dispersal, the opposing player of the first shooter will designate which disk of the shooter's target disk set will be the shooter's target (the more difficult to hit). The first player then shoots, and:

1. if he or she knocks the designated disk out of the play area, it's a keeper, but if any others are knocked out they are returned to the center of the play area;

2. if the shooter disk stays in the play area, the arrow thereon will indicate where the marker must be placed for the next shot when the shooter's turn come up again;

3. in any case, if the shooter disk leaves the play area, the marker must be placed at the point where the shooter disk left the play area;

4. before the second player shoots, the first shooter will designate which disk of the second player's target disk set will be the target (the most difficult shot), these two players will be adversaries;

5. the designated target disks must remain the targets of each player until it is knocked out, at which time the adversary player can dictate which disk his opponent must target next (the most difficult shot); and 6. the first player, or players, to knock out a complete target disk set wins the game.

GAME EXAMPLE 2

Game-pieces: 16 target disks composed of 8 red target disks numbered 1 through 8 and 8 white target disks numbered 9 through 16; 1 black disk; and 1 shooter disk having a yellow arrow indicia. Other accessories: smooth, low friction play surface member; one location marker per player; and the game-piece propelling mechanism is mounted to the base. Object: for each player to knock out of the play area the disks of his or her choice in numerical order.

The players choose colors and the target disks are arranged on the play area in a loose triangular or circular pattern with the black disk at the center. A coin is tossed (or otherwise) to see who plays first. The first shot of each player must be from the same location on the table.

EXAMPLES OF SUBSEQUENT PLAY 1. after the first shot by the first player, if no target disk leaves the play area and the shooter disk stays in the first play ends for the first player, the arrow on the shooter disk indicates the location from where the first player will next shoot and the first player places his or her marker there and awaits the next turn;

2. if the first player knocks out a disk of his or her choice from the play area and the shooter disk goes out also, he or she keeps the target disk as the score, but since the shooter disk went out of the play area, this completes his or her turn wherein the arrow will indicate from whence next to shoot and his or her marker is then placed at this location to await the next turn;

3. if the first player knocks out a disk of his or her choice and the shooter disk stays in the play area the player is allowed another shot wherein the arrow on the shooter disk will indicate from where that shot is to be taken; after the second shot is taken the player's turn is over (only two shots per turn are allowed) if the target disk of the player's choice is knocked out this adds to his or her score, and if the shooter disk is not knocked out where the arrow points determines where the next shot of the next turn is to be taken whereat the player's marker is placed, but if the shooter disk has been knocked out, then the location of the next shot will be from where the target disk left the play area.

The first player breaks the centered disks to disperse them. Any disks which leave the play area are returned thereto and centered. The first player then begins regular play, shooting again from the starting point, and aiming for the lowest numbered disk of his or her choice, per the above examples of subsequent play.

RULES OF REGULAR PLAY 1. in regular play, after the break, if any single target disk of the shooter's choice is knocked off the play area and is out of sequence it must be returned to the play area, and, as a penalty, must also replace and center the last disk he or she has knocked out (if there is no such disk, then this disk is owed to the table when it becomes available);

2. also, in regular play, after the break, if any single disk of an opposing player is knocked out of the play area, it must be replaced to its original location and the shooter, as a penalty, must also replace and center the last disk he or she has knocked out (if the shooter has no such disk, it is owed to the table when it becomes available).

IRREGULARITIES OF PLAY 1. when two disks of the shooter's choice leave the play area and the shooter's main target disk leaves first, followed by the disk of the next highest value, both count for the shooter;

2. when two disks of the shooter's choice leave the play area and the shooter's main target disk leaves first, followed by a disk out of sequence, they both must be returned and centered on the play area;

3. when two disks leave the play area and the shooter's main target disk leaves first, followed by an opponent's disk, the target disk is returned to the center of the play area and the opponent's to its original location; and 4. when two disks leave the play area and the opponent's disk leaves first, followed by the shooter's disk, the shooter's disk is returned to the center of the play area, the opponent's disk returned to the original location, and, as a penalty, the shooter must replace the last disk he or she has knocked out (if the shooter has no such disk, it is owed to the table when it becomes available).

The game ends when one player is the first to knock out all the disks of his or her choice and the black disk without the shooter disk leaving the play area.

GAME EXAMPLE 3

Game-pieces: 16 target disks, each being numbered sequentially; and 1 shooter disk having an arrow indicia. Other accessories: smooth, low friction play surface member; one location marker per player; and the game-piece propelling mechanism is mounted to the base; partitions are placed in the trough at selected locations; and markers are located on the confinement wall next to each partition to provide respective numerical designations. Object to end up with the highest score gained by propelling in sequence the numbered disks into the numbered partitions located in four places around the play area, wherein the value of the disk is added to the value of the partition to arrive at a score. Play continues until all the target disks have been played out, The game begins with the toss of a coin (or otherwise) to see who plays first (the looser can be first for the next game). The target disks are placed in a tight arrangement on the play area, and the first player propels the shooter disk thereinto to disperse the target disks; any target disks which fall into the trough are returned to the center of the play area.

After the dispersal shot, the first player makes his or her first shot aiming for the disk with the lowest value. The first shots of the players are from the location of the dispersal shot.

After the shot of the first player, if the proper disk is scored, the first player shoots again, aiming at the next highest value disk. If no score is made, then it is the next player's turn. In any event, a maximum of two shots are allowed per turn.

If any disk out of sequence leaves the play area or enters a numbered partition, it must be returned to the play area and centered. If the target disk leaves the play area, but misses a numbered partition, then it is also returned to the play area and centered.

If the shooter disk remains on the play area after a shot, the arrow thereon indicates from where the next shot for that player is to be taken; if the shooter disk leaves the play area, then the next shot for that player is to be taken form where the shooter disk left the play area. The player uses his or her marker to locate where this location is at in expectation of his or her next turn.

GAME EXAMPLE 4

Game-pieces: 16 unmarked target disks; and 1 shooter disk having an arrow indicia. Other accessories: smooth, low friction play surface member; one location marker per player; and the game-piece propelling mechanism is mounted to the base; partitions are placed in the trough at selected locations; and markers are located on the confinement wall next to each partition to provide respective numerical designations. Object to end up with the highest score gained by propelling target disks into numbered partitions, wherein scoring is determined by the value assigned to the partitions into which the disks are deposited. Play continues until all the target disks have been played out.

The game begins with the toss of a coin (or otherwise) to see who plays first (the looser can be first for the next game). The target disks are placed in a tight arrangement on the play area, and the first player propels the shooter disk thereinto to disperse the target disks; any target disks which fall into the trough are returned to the play area. The first shots of the players are from the location of the dispersal shot. One shot per turn applies, unless by pre-game agreement, such as continued shooting as long as scoring is achieved.

In this game, no direct contact by the shooter disk is allowed with the intended target disk. Two options of play are available:

1. the shooter disk may hit another target disk, ricochet and then hit the intended target disk to propel it toward a numbered partition; or 2. the shooter disk may hit one target disk to propel it toward the intended target disk to propel it toward the numbered partitions.

If the shooter disk remains on the play area after a shot, the arrow thereon indicates from where the next shot for that player is to be taken; if the shooter disk leaves the play area, then the next shot for that player is to be taken form where the shooter disk left the play area. The player uses his or her marker to locate where this location is at in expectation of his or her next turn.

GAME EXAMPLE 5

Game-pieces: 16 hidden numbered target disks; and 1 shooter disk having an arrow indicia. Other accessories: smooth, low friction play surface member; one location marker per player; and the game-piece propelling mechanism is mounted to the base; partitions are optionally placed in the trough at selected locations; and markers are located on the confinement wall next to each partition to provide respective numerical designations if the partitions are used. Object: to end up with the highest score gained by propelling target disks into trough or into the numbered partitions, wherein scoring is determined by 1) the hidden value of the disks successfully landed in the trough by a player, or 2) the value assigned to the partitions into which the target disks are deposited plus the value of the hidden values on those disks. Since the actual value of the target disks is not known until the game has played out, an enigmatic element that induces great excitement in the players exists until the tabulation is completed. Play continues until the target disks have been played out.

The game begins with the toss of a coin (or otherwise) to see who plays first (the looser can be first for the next game). The target disks are placed in a tight arrangement on the play area, and the first player propels the shooter disk thereinto to disperse the target disks; any target disks which fall into the trough are returned to the play area. The first shots of the players are from the location of the dispersal shot.

In this game, contact by the shooter disk with any target disk is allowed. That is:

a) by hitting any target disk to score directly by the shooter disk;

b) by hitting one target disk and ricocheting to propel another target disk to score (this method could produce two scores); and c) by hitting one target disk directing it toward another target disk to hit it to score.

If the shooter disk remains on the play area after a shot, the arrow thereon indicates from where the next shot for that player is to be taken; if the shooter disk leaves the play area, then the next shot for that player is to be taken form where the shooter disk left the play area. The player uses his or her marker to locate where this location is at in expectation of his or her next turn.

Because scoring involves hidden numbers on the target disks which is not known until the game is over, any player win. Where the numbered partitions are used, the score is tabulated by combining the value of the target disk with the value of the partition in which it lies. In this scenario of play, a player having scored fewer successful partition deposits could still be the winner. Handicap points can be given to less proficient players, as is done in golf or bowling.

GAME EXAMPLE 6

Game-pieces: a set of marbles identifiable for each player. Other accessories: padded play surface member and padded basal surface member (the game-piece propelling mechanism being removed). Partitions and their associated numerically designating markers are optional. Object: to be first player to knock all of the opponent's marbles into the trough.

The game begins by the toss of a coin to see who goes first. The player's marbles are centrally positioned on the playing area. Each player in turn "knuckles-down" by shooting his or her marble by snapping one's thumb with respect to the fore-finger into the collection of marbles with the intention of knocking an opponent's marble into the trough. The player continues to knuckle-down until he or she misses a shot. If he knocks one of his own marbles into the trough, the score is for his or her opponent and does not count toward continued play.

A variation on this game is to require marbles be deposited into selected partitions which may be identified by use of the markers placed on the confinement wall.

Another variation of this game is to use the game-piece propelling mechanism to shoot the marbles.

GAME EXAMPLE 7

Game-pieces: a set of marbles identifiable for each player. Other accessories: a marker for each player, padded play surface member and padded basal surface member (the game-piece propelling mechanism being removed). Partitions and their associated numerically designating markers are optional. Object: to be first player to knock all of the opponent's marbles into the trough.

The game begins by the toss of a coin to see who goes first. The player's marbles are centrally positioned on the playing area. Each player in turn "knuckles-down" by shooting his or her marble by snapping one's thumb with respect to the fore-finger into the collection of marbles with the intention of knocking an opponent's marble in to the trough.

The first shot of each player is from the basal play surface member. Thereafter, each player plays from where the last marble they hit left the playing area. The player uses his or her marker to locate where this location is in expectation of his or her next turn.

The player continues to knuckle-down until he or she misses a shot. If he knocks one of his own marbles into the trough, the score is for his or her opponent and does not count toward continued play.

A variation on this game is to require marbles be deposited into selected partitions which may be identified by use of the markers placed on the confinement wall.

Another variation of this game is to use the game-piece propelling mechanism to shoot the marbles.

It will be noted that the substitutability of one play surface member by another and of one basal surface member by another provides a player selected type of surface that is suitable for the play of a selected type of game-piece. For example, a hard and smooth type of surface is suitable for the play of sliding game pieces, as represented for example by disks; further for example, a felt covered, padded type of surface is suitable for the play of rolling game pieces, as represented for example by marbles; and still further for example, a rolling game-piece may be used with either a smooth and hard type of surface or a felt covered, padded type of surface, as desired.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A table top game apparatus for playing game-pieces, comprising:

a table top comprising:

a play area having a flat play surface, said play surface having a perimeter;

an annular trough adjacent said perimeter, said trough having a conveyance seat formed therein; and an annular confinement wall adjacent said trough and opposite said perimeter, said confinement wall having a preselected height above said play surface such that game-pieces moving along said play surface are restrained by said confinement wall from leaving said table top;

a base seated in said conveyance seat wherein said base is movable along said trough; and game-piece propelling mechanism means for propelling game-pieces, said game-piece propelling mechanism means being rotatably mounted to said base.

2. The table top game apparatus of claim 1, further comprising partition means for selectively partitioning said trough.

3. The table top game apparatus of claim 1, further comprising marker means for being selectively located upon said confinement wail to thereby indicate information relevant to each respective selected location.

4. The table top game apparatus of claim 1, further comprising a plurality slidable game-pieces, wherein said plurality of game-pieces includes at least one shooter game-piece having directional indicia, said shooter game-piece being structured to be propelled by said game-piece propelling mechanism means.

5. The table top game apparatus of claim 4, wherein said plurality of game-pieces includes at least one game piece having means for selectively concealing indicia thereof.

6. The table top game apparatus of claim 1, further comprising means for supporting said table top at a selected height above a floor and for providing leveling adjustment of said playing surface.

7. The table top game apparatus of claim 1, further comprising means for rollingly interfacing said base with respect to said inner and outer ledge portions.

8. The table top game apparatus of claim 1, wherein said game-piece propelling mechanism means comprises:

a housing rotatably mounted to said base;

a percussion actuator slidably mounted to said housing;

biasing means for propelling said percussion actuator with respect to said housing responsive to sliding movement of said percussion actuator in a first direction with respect to said housing;

knob means for providing a location for a user to slidingly move said percussion actuator with respect to said housing;

and game-piece seat means for providing a seat for receiving a game-piece at a location wherein said percussion actuator strikes propellingly said game-piece when sliding in a second direction under urging from said biasing means.

9. The table top game apparatus of claim 8, wherein said trough comprises:

said conveyance seat, wherein said conveyance seat comprises:

an inner wall adjacent said perimeter;

an outer wall adjacent said confinement wall;

an inner ledge portion adjoining said inner wall, said inner ledge portion being oriented parallel with respect to said play surface; and an outer ledge portion adjoining said outer wall, said inner ledge portion being oriented parallel with respect to said play surface; and a bottom portion situated between said inner and outer ledge portions, said bottom portion being configured to receive therein game pieces;

wherein said base movably seats in guidable relation with respect to said inner and outer walls and said inner and outer ledge portions.

10. The table top game apparatus of claim 9, further comprising means for supporting said table top at a selected height above a floor and for providing leveling adjustment of said playing surface.

11. The table top game apparatus of claim 9, further comprising selectively removable game surface member means for providing a selected type of surface at said play area.

12. The table top game apparatus of claim 11, wherein said game-piece propelling mechanism means is removably mounted to said base; said table top game apparatus further comprising basal surface member means for providing a selected type of surface at said base which conjoins said play surface at said play area after said game-piece propelling mechanism means has been removed from said base.

13. The table top game apparatus of claim 12, further comprising means for supporting said table top at a selected height above a floor and for providing leveling adjustment of said playing surface.

14. A table top game apparatus for playing game-pieces, comprising:

a table top comprising:

a play area having a flat play surface, said play surface having a perimeter;

an annular trough adjacent said perimeter, said trough having a conveyance seat formed therein;

partition means for selectively partitioning said trough; and an annular confinement wall adjacent said trough and opposite said perimeter, said confinement wall having a preselected height above said play surface such that game-pieces moving along said play surface are restrained by said confinement wall from leaving said table top;

a base seated in said conveyance seat wherein said base is movable along said trough;

a plurality of slidable game-pieces;

game-piece propelling mechanism means for propelling at least one game-piece of said plurality of game-pieces, said game-piece propelling mechanism means being rotatably mounted to said base; and means for supporting said table top at a selected height above a floor and for providing leveling adjustment of said playing surface.

15. The table top game apparatus of claim 14, further comprising marker means for being selectively located upon said confinement wall to thereby indicate information relevant to each respective selected location.

16. The table top game apparatus of claim 14, wherein said plurality of game-pieces comprises at least one of: a game piece having means for selectively concealing indicia thereof; and a shooter game-piece having directional indicia.

17. The table top game apparatus of claim 14, further comprising means for rollingly interfacing said base with respect to said inner and outer ledge portions.

18. The table top game apparatus of claim 14, wherein said game-piece propelling mechanism means comprises:

a housing rotatably mounted to said base;

a percussion actuator slidably mounted to said housing;

biasing means for propelling said percussion actuator with respect to said housing responsive to sliding movement of said percussion actuator in a first direction with respect to said housing;

knob means for providing a location for a user to slidingly move said percussion actuator with respect to said housing;

and game-piece seat means for providing a seat for receiving said at least one game-piece at a location wherein said percussion actuator strikes propellingly the game-piece when sliding in a second direction under urging from said biasing means.

19. The table top game apparatus of claim 14, wherein said trough comprises:

said conveyance seat, wherein said conveyance seat comprises:

an inner wall adjacent said perimeter;

an outer wall adjacent said confinement wall;

an inner ledge portion adjoining said inner wall, said inner ledge portion being oriented parallel with respect to said play surface; and an outer ledge portion adjoining said outer wall, said inner ledge portion being oriented parallel with respect to said play surface; and a bottom portion situated between said inner and outer ledge portions, said bottom portion being configured to receive therein game pieces;

wherein said base movably seats in guidable relation with respect to said inner and outer walls and said inner and outer ledge portions.

20. The table top game apparatus of claim 14, wherein said game-piece propelling mechanism means is removably mounted to said base; said table top game apparatus further comprising:

selectively removable game surface member means for providing a selected type of surface at said play area; and basal surface member means for providing a selected type of surface at said base which conjoins said play surface at said play area after said game-piece propelling mechanism means has been removed from said base.

* * * * *